US011022105B2

(12) United States Patent
Kane

(10) Patent No.: US 11,022,105 B2
(45) Date of Patent: Jun. 1, 2021

(54) CONNECTOR PLATE, HYDRAULIC MACHINE HAVING A CONNECTOR PLATE, AND HYDROSTATIC UNIT HAVING A HYDRAULIC MACHINE AND A HYDRAULIC ATTACHMENT PART

(71) Applicant: Robert Bosch GmbH, Stuttgart (DE)

(72) Inventor: Brian Kane, Lohr Am Main (DE)

(73) Assignee: Robert Bosch GmbH, Stuttgart (DE)

( * ) Notice: Subject to any disclaimer, the term of this patent is extended or adjusted under 35 U.S.C. 154(b) by 430 days.

(21) Appl. No.: 15/909,316

(22) Filed: Mar. 1, 2018

(65) Prior Publication Data

US 2018/0252209 A1 Sep. 6, 2018

(30) Foreign Application Priority Data

Mar. 1, 2017 (DE) ..... 10 2017 203 281.2

(51) Int. Cl.

| | |
|---|---|
| ***F04B 1/2064*** | (2020.01) |
| ***F04B 53/16*** | (2006.01) |
| ***F04B 53/22*** | (2006.01) |
| ***F04B 1/2078*** | (2020.01) |
| ***F04B 1/2007*** | (2020.01) |
| ***F04B 1/20*** | (2020.01) |
| ***F04B 1/324*** | (2020.01) |

(Continued)

(52) U.S. Cl.

CPC ..... *F04B 1/2064* (2013.01); *F04B 1/14* (2013.01); *F04B 1/20* (2013.01); *F04B 1/2007* (2013.01); *F04B 1/2035* (2013.01); *F04B 1/2078* (2013.01); *F04B 1/324* (2013.01); *F04B 23/106* (2013.01); *F04B 53/16* (2013.01); *F04B 53/22* (2013.01)

(58) Field of Classification Search

CPC ..... F04B 1/324; F04B 49/08; F04B 1/2042; F04B 1/2035; F04B 1/2064; F04B 23/106; F04B 1/2078; F04B 49/002; F04B 1/2085; F04B 1/20; F04B 1/2007; F04B 1/2021; F04B 1/145; F04B 1/30; F04B 1/32; F04B 53/22; F04B 53/16

See application file for complete search history.

(56) References Cited

U.S. PATENT DOCUMENTS 2,604,047 A * 7/1952 Beaman ..... F04B 1/2078 417/206
2,769,393 A * 11/1956 Cardillo ..... F01B 3/0052 417/203

(Continued)

FOREIGN PATENT DOCUMENTS

DE 10 2010 013 008 A1 10/2010

*Primary Examiner* — Peter J Bertheaud

(74) *Attorney, Agent, or Firm* — Maginot, Moore & Beck LLP

(57) ABSTRACT

A connector plate, for mechanically and hydraulically connecting a hydraulic machine with a hydraulic attachment part, includes a plurality of hydrostatic connector recesses. Each recess has a first side that includes a first orifice opening to the hydraulic attachment part, and a second side with a second orifice opening to the hydraulic machine. The plurality of orifices are arranged so as to open in a substantially axially parallel manner with respect to a drive shaft of the hydraulic machine. A hydraulic machine includes such a connector plate, and a hydrostatic unit includes such a hydraulic machine and a hydraulic attachment part.

11 Claims, 5 Drawing Sheets

(51) Int. Cl.

| | |
|---|---|
| ***F04B 23/10*** | (2006.01) |
| ***F04B 1/14*** | (2020.01) |
| ***F04B 1/2035*** | (2020.01) |

(56) References Cited

U.S. PATENT DOCUMENTS

| | | | | | |
|---|---|---|---|---|---|
| 3,257,959 | A * | 6/1966 | Budzich | F04B 49/08 | 417/222.1 |
| 3,422,767 | A * | 1/1969 | Mcalvay | F04B 1/324 | 91/505 |
| 3,744,377 | A * | 7/1973 | Lauck | F03C 1/0636 | 91/489 |
| 3,868,889 | A * | 3/1975 | Bobier | F04B 1/20 | 91/506 |
| 3,982,470 | A * | 9/1976 | Adams | F01B 3/106 | 91/506 |
| 4,105,369 | A * | 8/1978 | McClocklin | F04B 1/14 | 417/206 |
| 6,332,393 | B1 * | 12/2001 | Trimble | F01B 13/04 | 417/239 |
| 7,708,531 | B2 * | 5/2010 | Sakikawa | F04B 1/2014 | 417/269 |
| 8,974,203 | B2 * | 3/2015 | Crosby | F04B 1/2021 | 137/513.7 |
| 10,125,752 | B1 * | 11/2018 | Bonny | F03C 1/0697 | |
| 2004/0175277 | A1 * | 9/2004 | Cox | F04B 1/2064 | 417/239 |

* cited by examiner

A - A

CONNECTOR PLATE, HYDRAULIC MACHINE HAVING A CONNECTOR PLATE, AND HYDROSTATIC UNIT HAVING A HYDRAULIC MACHINE AND A HYDRAULIC ATTACHMENT PART

This application claims priority under 35 U.S.C. § 119 to patent application no. DE 10 2017 203 281.2, filed on Mar. 1, 2017 in Germany; the disclosure of which are incorporated herein by reference in its entirety.

The disclosure relates to a connector plate, to a hydraulic machine, and to a hydrostatic unit.

In the case of what is known as a compact axle which can also be called a hydrostatic unit in the following text, a drive machine which is usually electric, a hydraulic machine, a hydraulic attachment part, for example a control valve or control valve block, and a hydraulic consumer, for example a hydraulic cylinder, are combined to form a compact structural unit. Here, in particular, space-saving arrangements and therefore configurations of the individual component and of the overall structural unit are desired and advantageous. One possibility is to arrange at least some of the abovementioned components "in line" or in an aligned manner, with the result that a comparatively long, but advantageously narrow installation space can be utilized.

Document DE 10 2010 013 008 has disclosed, for example, an axial piston machine of swash plate design for a hydrostatic unit, which has a connector plate with connector bores toward the control block as a connector adapter. Here, said connector bores have internal threads which are provided for screwing connector hoses or connector pipelines. Therefore, comparatively flexible hoses or lines which are intensive in terms of installation space are to be provided between the module of the axial piston machine having the connector plate and the control block which is to be connected to it.

It is a disadvantage of said solution that the resulting hydrostatic unit requires a long installation space if assessed in the direction of the driveshaft of the hydraulic machine. In addition, the use of the hoses or pipes for connecting the control block is susceptible to leaks.

SUMMARY

In contrast, the disclosure is based on the object of providing a connector plate for a hydraulic machine, via which connector plate a hydrostatic unit with a relatively low installation space requirement is made possible. It is a second object of the disclosure to provide a hydraulic machine which makes a hydrostatic unit which saves installation space possible. A third object consists in providing a hydrostatic unit which saves as much installation space as possible.

The first object is achieved by way of a connector plate according to this disclosure, the second object is achieved by way of a hydraulic machine according to this disclosure, and the third object is achieved by way of a hydrostatic unit according to this disclosure.

Advantageous developments of the inventions are described in the description, drawings, and claims.

A connector plate for the mechanical and hydraulic connection of a hydraulic machine, in particular of a hydrostatic axial piston machine, in particular of swash plate design, having a hydraulic attachment part, in particular a hydraulic control valve, is penetrated by hydrostatic connector recesses. The latter have orifices on sides of the connector plate which point away from one another. Here, orifices for the pressure medium connection with the attachment part are provided on one side, and the orifices for the pressure medium connection with the hydraulic machine are provided on the other side. In order to ensure a linear or aligned arrangement of the attachment part with the hydraulic machine in a manner which is simple in terms of apparatus technology, the orifices are oriented in a substantially axially parallel manner with respect to a drive axle of the connectable hydraulic machine. According to the disclosure, first fastening means are provided on the connector plate, via which first fastening means the connection with the attachment part can be carried out in a block-like manner. Block-like means, in particular, that the hydraulic connection can be configured without hoses or pipes, in particular by way of direct and fixed connection of the connector plate to the attachment part.

Fundamentally, the type of the connection of the components, both a mechanical and a hydraulic type, are given great importance for the skillful utilization of the installation space. An amount of installation space which can be taken up of a module which consists of the connector plate and an attachment part is reduced in the direction of the driveshaft by way of the block-like, in particular direct and fixed connection which is made possible in accordance with the disclosure. This is true, in particular, with respect to those cases in which the connection of the connector plate to the attachment part has had to take place by means of hoses or pipes. With respect to said case, the block-like connection makes it possible, in addition, that it has less fragile sealing points. The mechanical and fluidic connection can therefore be configured with high strength, reliability and tightness.

As a result of the block-like construction of the connection, additional parts which have been necessary up to now for the mechanical/hydraulic connection are omitted or become superfluous. As a result, the overall complexity, in particular a number of parts and a weight, are reduced. The costs for producing the connector plate, the hydraulic machine and the unit are also reduced as a result.

Those sides of the connector plate which have the orifices are preferably parallel to one another. In particular, the direction of the driveshaft represents a perpendicular of the sides. The sides are preferably of predominantly planar configuration. An exception to this can be, for example, regions of the sides, in which regions recesses or bulges are provided for functional elements, for example seal or bearing elements.

In one preferred development, the connector plate has second fastening means for the block-like (in particular, hose-free or pipe-free) connection to the hydraulic machine.

The fastening means are preferably arranged away from the orifices. In relation to the direction of the driveshaft, for example, this can be radially outside the region, in which the orifices are arranged. As an alternative or in addition, individual fastening means or all the fastening means can be provided within said region.

In one development, the fastening means have, for example, bores, in particular through bores.

Here, the bores can be configured at least in sections with an internal thread or without a thread.

In one development, the fastening means have screws in a manner which is appropriate with respect to the bores.

It is of course possible in principle that, for example, the first fastening means are provided both for the connection of the connector plate to the attachment part and for the connection of the connector plate to the hydraulic machine.

In one preferred development, in each case one of two of the connector recesses of the connector plate can be assigned, in particular is assigned, to a working connector of the hydraulic machine. In particular, a connector which passes into the pressure medium connection with one or more hydrostatic working spaces of the hydraulic machine during operation of the hydraulic machine is considered to be a working connector here.

In one development, a third one of the connector recesses can be assigned, in particular is assigned, to a leakage connector of the hydraulic machine.

In one development, a fourth one of the connector recesses can be assigned, in particular is assigned, to a load signaling connector of the hydraulic machine.

Further connector recesses with associated connectors on the hydraulic machine are possible and increase the degree of integration of the mechanical and fluidic connection via the connector plate.

In one development, the attachment part-side orifices represent a hole pattern which is the same as a hole pattern of the attachment part.

In one development, the hydraulic machine-side orifices represent a hole pattern which is approximately the same as a hole pattern of the hydraulic machine.

The hole patterns which are assigned to one another in this way being the same means that the hole patterns are adapted to one another, at least as far as a number of orifices, their position and/or shape and their function are concerned.

In one development, an additional function for the hydraulic machine is configured by the connector plate, by the latter having a bearing seat for the driveshaft of the hydraulic machine. The bearing seat is preferably arranged centrally, in particular concentrically, in relation to the hydraulic machine-side orifices.

A hydraulic machine, in particular a hydrostatic axial piston machine, which is configured, in particular, in a swash plate design has a housing and, in addition, a connector plate which is configured in accordance with at least one aspect of the preceding description. Here, the connector plate is connected according to the disclosure via second fastening means to the housing in a block-like manner; in other words, without the necessity of hoses or pipes, in particular in a hose-free or pipe-free manner.

It is possible by means of the connector plate which is attached in this way to connect the hydraulic machine to the attachment part in a block-like manner, in particular in a direct and fixed manner, as a result of which installation space which can be taken up in the direction of the driveshaft is reduced, as has been mentioned. Otherwise, the same advantages apply as have already been mentioned in the case of the connector plate alone.

The applicant reserves the right to direct a patent request to a module comprising a hydraulic attachment part, in particular a control valve, and the connector plate in accordance with the preceding description. Here, the connector plate is placed onto the attachment part, in particular a valve block or a valve housing of the control valve, and is connected to said attachment part via the first fastening means in a block-like manner, in other words without the necessity of lines or pipes. The attachment part preferably has an associated pressure medium duct for each of the hydrostatic connector recesses or at least for some of them.

In one development, the hydraulic machine is configured as an axial piston machine, in particular of swash plate design.

In one development, the axial piston machine has a driveshaft and a cylinder barrel which is connected fixedly to said drive shaft so as to rotate with it, in which cylinder barrel cylinder bores are made in a manner which is distributed about the driveshaft. Working pistons are guided displaceably in said cylinder bores, with the result that hydrostatic working spaces are delimited via said working pistons in the cylinder bores. The orifices of said working spaces pass into alternating pressure medium connection with the two connector recesses of the connector plate which are mentioned in the description, upon rotation of the driveshaft.

In order for it to be possible to fasten a drive unit to the hydraulic machine, said hydraulic machine has, in one development, an attachment flange for a drive unit, in particular an electric machine, on a side of its housing which is arranged opposite the connector plate.

In one development, the hydraulic machine has a control plate which is arranged between the cylinder barrel and the connector plate. The control plate has through recesses, the hole pattern of which is approximately the same as the hole pattern of the hydraulic machine-side orifices of the connector plate.

In one development, the likeness of the hole patterns relates at least to the through recesses of the control plate and to the connector recesses of the connector plate which are provided for the alternating pressure medium connection with the working spaces.

In one development, the orifices of the working spaces are arranged at least in sections on an identical pitch circle with those of the through recesses of the control plate.

If the through recesses penetrate the control plate parallel to the driveshaft, the hydraulic machine-side orifices of the connector recesses of the connector plate are also arranged at least in sections on the pitch circle in one development.

A hydrostatic unit, in particular a hydrostatic module, has a hydraulic machine which is configured in accordance with the preceding description, and a hydraulic attachment part, in particular a control valve, which is placed onto the connector plate and is connected mechanically and hydraulically to said connector plate via the first fastening means in a block-like manner, in other words without lines or pipes.

A unit/module which is very compact at least in the direction of the driveshaft of the hydraulic machine is formed by way of the block-like connection of the connector plate both to the attachment part and to the hydraulic machine. Here, the hydraulic connections are tight and rigid, as a result of which a reliability and efficiency of the unit is increased.

A particularly slim installation space is taken up if the hydraulic machine is arranged in alignment in the direction of the driveshaft via its connector plate with the attachment part.

In one development, the first fastening means have connecting bores which extend directly (that is to say, without deflection) from the attachment part, in particular from a block, into the control plate of the hydraulic machine. As a result, the hydraulic machine, in particular the hydraulic pump, can be operated at a higher rotational speed. In the case of the hydraulic pump, the reason for this is that an intake pressure at the associated working connector does not drop as a result of the direct connection to such a pronounced effect as in the case of a more indirect connection, for example by means of a hose.

In one development, the unit has a drive unit which is arranged, in particular flange-connected, on the hydraulic machine in alignment in the direction of the driveshaft. A sequence in said direction then results as follows: drive unit, hydraulic machine with connector plate, attachment part. Here, all the connections are preferably of block-like and therefore particularly rigid and tight configuration.

In one development, the unit also has a hydraulic consumer, for example a hydraulic cylinder, which can be supplied with pressure medium by the hydraulic machine and can thus be driven. A particularly slim installation space is also taken up here if all the abovementioned components are in alignment with one another. As an alternative to this, the consumer can of course be arranged parallel to or outside the alignment.

BRIEF DESCRIPTION OF THE DRAWINGS

In each case one exemplary embodiment of a connector plate according to the disclosure, a hydraulic machine according to the disclosure and a hydrostatic unit according to the disclosure is shown in the drawings. The disclosure will now be described using the figures of said drawings, in which.

DETAILED DESCRIPTION

Figure 1:
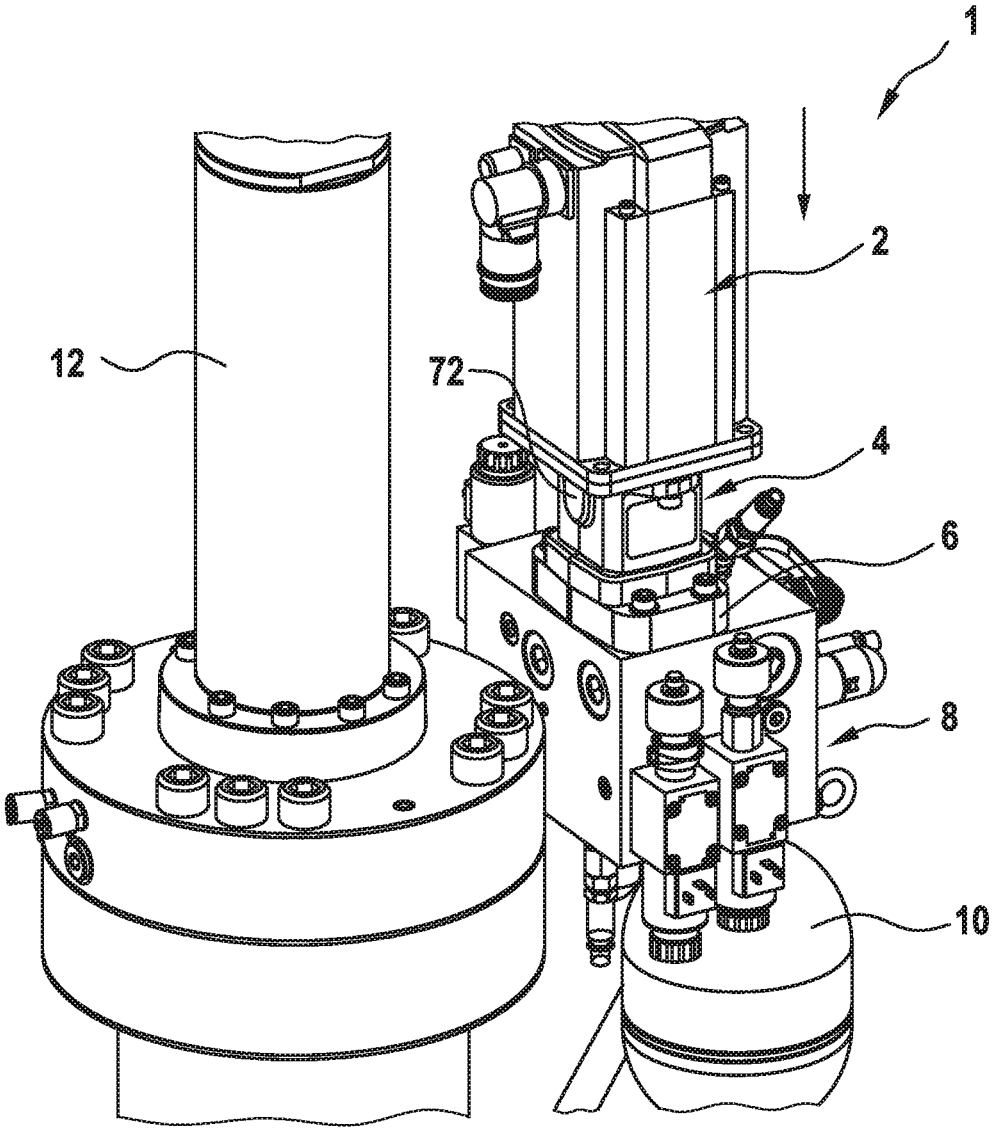
FIG. 1 shows a hydrostatic unit in accordance with one exemplary embodiment in a perspective view.

FIG. 1 shows a hydrostatic unit 1 having an electric drive unit 2, a hydraulic machine 4 which is configured in a swash plate design as an axial piston machine, a connector plate 6, an attachment part 8 which is configured as a control valve block, a hydraulic accumulator 10 and a hydraulic cylinder 12.

The hydrostatic unit 1 can also be called an "autonomous axle", since, in addition to the linearly acting hydraulic cylinder 12, it also has the necessary components for driving it and supplying it with pressure medium, namely the drive unit 2, the hydraulic machine 4 and the control valve block 8.

It can be seen clearly here that the connector plate 6 is arranged in a sandwich-like manner between the hydraulic machine 4 and the control valve block 8 (attachment part). Here, the mechanical and fluidic connection of the connector plate 6 both to the hydraulic machine 4 and to the control valve block 8 is in each case of block-like configuration, that is to say without the necessity of hoses or pipes. In this way, the hydraulic machine 4, the connector plate 6 and the control valve block 8 as one module form a compact, comparatively rigid construction which is simple in terms of apparatus technology. Here, the respective connection of the hydraulic machine 4 to the connector plate 6 and of the control valve block 8 to the connector plate 6 can be called "of block-like configuration".

In the exemplary embodiment which is shown, the arrangement of the drive unit 2, the hydraulic machine 4, the connector plate 6 and the control valve block 8 is "in line", in principle parallel to the drive axis (not shown) of the hydraulic machine 4.

Figure 2:
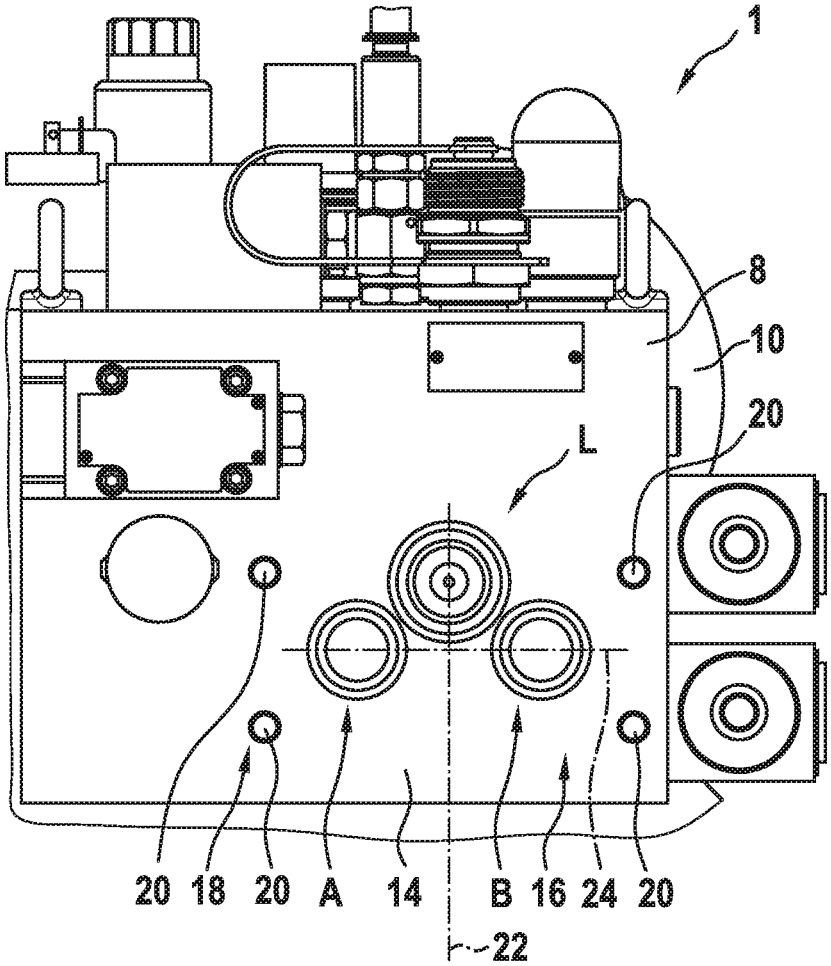
FIG. 2 shows the hydraulic unit according to FIG. 1 with a dismantled connector plate and axial piston machine.

FIG. 2 shows the hydrostatic unit 1 in a view in the direction of the arrow in accordance with FIG. 1, that is to say approximately from the view of the drive unit 2 or the hydraulic machine 4, the drive unit 2, the hydraulic machine 4 and the connector plate 6 being dismantled. The view of a connector face 14 of the valve control block 8 is therefore revealed. Here, the connector face 14 is of substantially planar configuration and has a connector hole pattern 16 with two working connectors A, B and a leakage connector L.

In order to seal the connector plate against the attachment part, in each case one groove, in particular a rectangular groove, is provided in each case radially outside the connectors A, B, L of the attachment part, in each case around the full circumference of the latter. A seal ring with a round cross section (O-ring) or a rectangular cross section (R-ring) can be arranged, in particular is arranged, in said groove.

As an alternative, the grooves which were mentioned above are arranged on that side or face of the connector plate which points toward the attachment part.

As an alternative, hybrid forms are possible, in which at least one groove, in particular with a seal ring, is arranged on the side of the attachment part and at least one groove, in particular with a seal ring, is arranged on the side of the connector plate.

Furthermore, the connector face 14 has a fastening hole pattern 18 with four blind bores 20 which are provided in a rectangular arrangement and, in relation to a center point between the working connectors A, B, are situated away from them, radially outside them. A rectangle which can be defined by the blind bores 20 has axes of symmetry 22 and 24, the two working connectors A, B being arranged on the axis of symmetry 24, and the leakage connector L being arranged on the axis of symmetry 22. Here, a center point of the leakage connector L lies approximately on an imaginary connecting line of two blind bores 20 of one longitudinal side of the rectangle.

Figure 3:
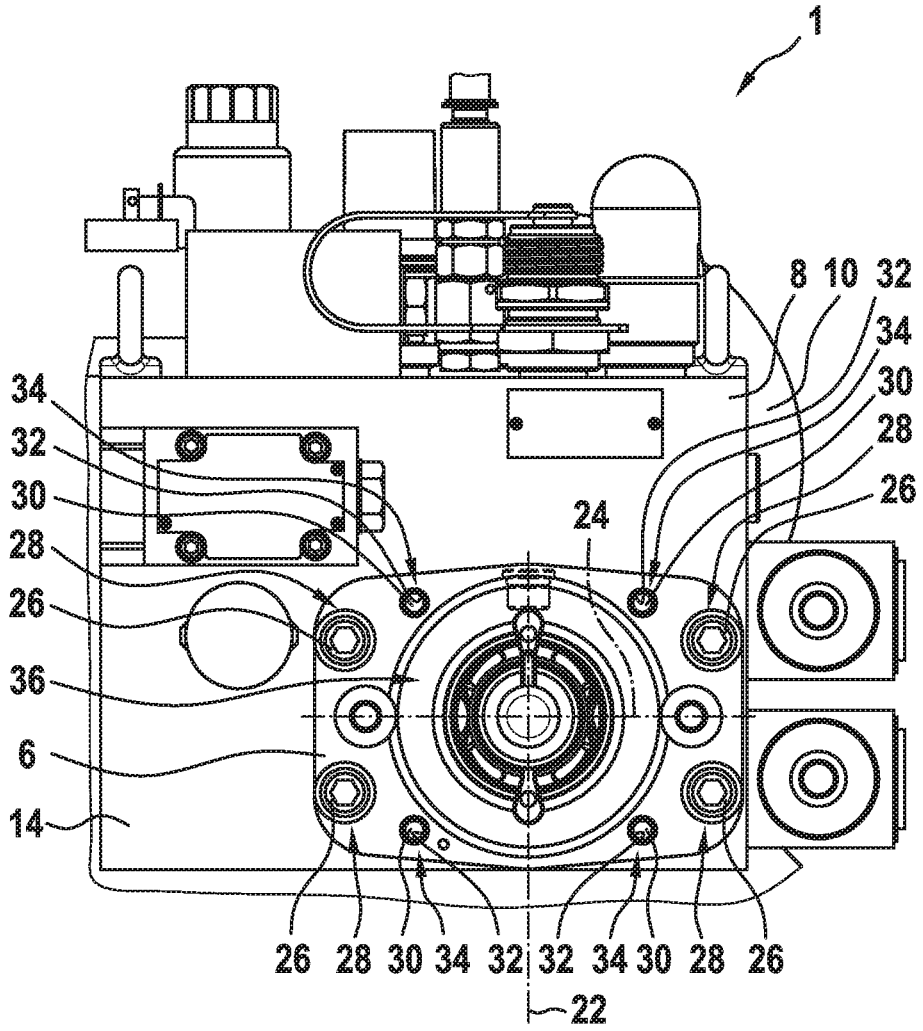
FIG. 3 shows the hydrostatic unit according to FIGS. 1 and 2 with a dismantled axial piston machine.

FIG. 3 shows the hydrostatic unit 1 in accordance with FIG. 2 with a mounted connector plate 6. In relation to FIG. 2, it can be seen clearly that first fastening screws 26 which penetrate the connector plate 6 are provided in congruence with the blind bores 20 in accordance with FIG. 2. Said first fastening screws 26 engage through threadless through bores (not shown) of the connector plate 6 and are screwed into the blind bores 20 in accordance with FIG. 2 which have an internal thread. In this way, the connector plate 6 is mechanically and fluidically connected to the control valve block 8 in a compact and rigid manner. The first fastening screws 26 with the through recesses which are concealed by them in FIG. 3 therefore represent first fastening means 28 which belong to the connector plate 6 and serve for the block-like (that is to say, hose-free or pipe-free) connection of the control valve block 8 to the connector plate 6.

Furthermore, thread run-outs of fastening screws 30 which penetrate through bores 32 of the connector plate 6 can be seen in FIG. 3. Accordingly, the respective screw head is situated on the side which faces away from the observer, that is to say facing the connector face 14 of the control valve block 8. Here, the through recesses 32 are likewise of threadless configuration. The fastening screws 30 together with the through bores represent second fastening means 34, via which a housing 72 of the hydraulic machine 4 in accordance with FIG. 1 can be attached to the connector plate 6.

The second fastening means 34 therefore make the block-like connection in a mechanical and hydraulic way of the hydraulic machine 4 to the connector plate 6 possible, which connection likewise proves to be rigid and compact.

Furthermore, FIG. 3 shows that the connector plate 6 is penetrated by connector recesses A', B' which have kidney-shaped orifices 38, 40 on one side 36 of the connector plate 6, which side 36 points toward the hydraulic machine. Here, the orifices 38, 40 have approximately the shape of correspondingly kidney-shaped through recesses of a control plate (cf. 104, FIG. 7) of the hydraulic machine 4. Here, the orifices 38, 40 run approximately on a pitch circle, on which center points of the working connectors A, B of the control valve block 8 in accordance with FIG. 2 are also arranged.

Furthermore, FIG. 3 shows that the connector plate 6 has a bearing seat 42 for a drive shaft (cf. 82, FIG. 7) of the hydraulic machine 4, which bearing seat 42 is arranged centrally in relation to the connector recesses A', B' and the fastening means 28, 34.

Approximately in the region of dead centers between the orifices 38, 40 of the connector recesses A, B', in each case one substantially droplet-shaped leakage duct 44, 46 is configured on both sides of the bearing seat 42, which leakage duct 44, 46 is in pressure medium connection with the bearing seat 42. Here, the leakage ducts 44, 46 are configured as recessed pressure pockets in the material. Here, a leakage bore 48 leads as a through bore out of the leakage duct 46, which leakage bore 48 is in pressure medium connection with the leakage connector L in accordance with FIG. 2 of the control valve block 8. Here, the two leakage ducts 44, 46 are connected fluidically via an annular and groove-shaped leakage duct 50 which extends concentrically, radially outside the connector recesses A', B'.

Figure 4:
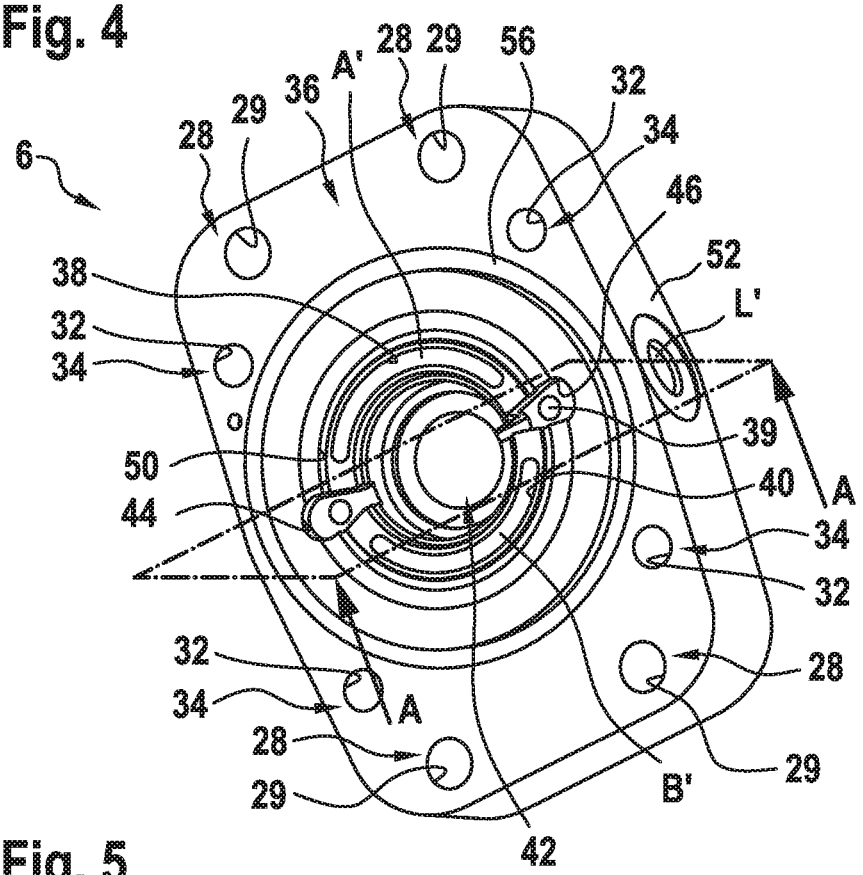
FIG. 4 shows the connector plate according to FIGS. 1 and 3 in a perspective view, approximately from the direction of the axial piston machine.

FIG. 4 shows the connector plate 6 in accordance with the preceding figures in a perspective view, as results from FIG. 1 but tilted toward the observer to a somewhat greater extent. It can be seen as additional information, in particular, that the view, for example, through the hydraulic machine-side orifice 38 through the hydrostatic connector recess A' as far as the orifice on the other side which is situated on the connector plate 6 on the attachment part-side is free. It is accordingly shown that the connector recesses A', B' have kidney-shaped orifices 38, 40 on the hydraulic machine side and circular orifices toward the control valve block 8. The latter are approximately congruent with the working connectors A, B in accordance with FIG. 2 of the control valve block 8.

Furthermore, an edge-side, secondary leakage connector L' can be seen on a longitudinal side 52 which is adjacent with respect to the leakage duct 46. Said secondary leakage connector L' branches off from the leakage through bore 48 approximately at a right angle laterally toward the outside to the longitudinal side 52, out of which it opens. A cross section which is defined by the plane of symmetry A-A in accordance with FIG. 4 gives an insight into the geometric configuration of said secondary leakage connector L' and the connector plate 6. Here, the plane of symmetry is defined by the axis of symmetry 22 in accordance with FIG. 3 in a direction perpendicularly with respect to the side 36.

In addition, a seal groove 56 which encompasses the orifices 38, 40 and the leakage ducts 44, 46 in a circular manner and radially on the outside can be seen clearly in FIG. 4. Here, in the assembled state, a seal ring is inserted, for example an O-ring (90, cf. FIG. 7), via which seal ring a housing of the hydraulic machine 4 is shut off in a fluidtight manner against the connector plate 6. The above-mentioned through bores 29 of the first fastening means 28 can be gathered as further information from FIG. 4, through which through bores 29 the first fastening screws 26 penetrate, in order to fasten the connector plate 6 to the control valve block 8 by means of the blind bores 20 with an internal thread which are provided there.

Figure 5:
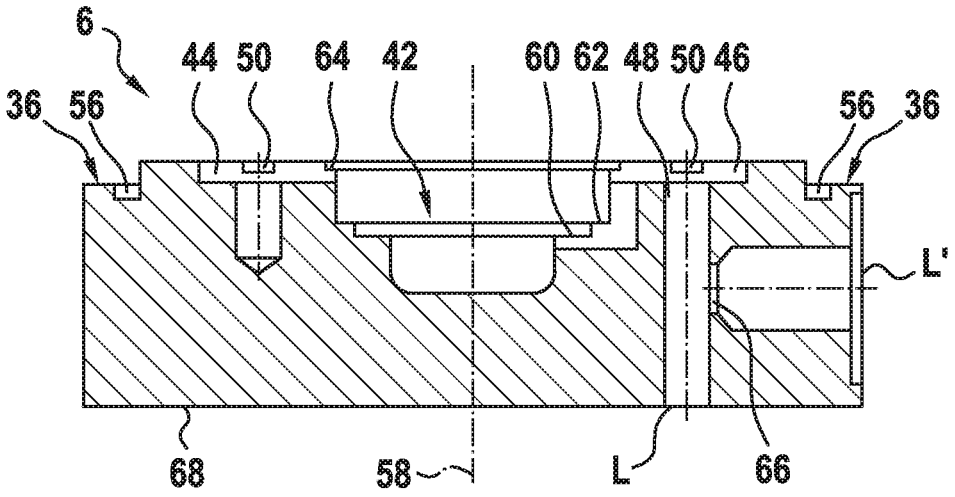
FIG. 5 shows the connector plate according to FIG. 4 in cross section.

FIG. 5 shows the section A-A in accordance with FIG. 4. Here, the connector plate 6 extends with a vertical axis 58 parallel to the driveshaft of the hydraulic machine, and has a lower height than width or length. In relation to FIGS. 3 and 4, the bearing seat 42 extends as a pocket-shaped recess with a rounded bottom in a rotationally symmetrical manner about the vertical axis 58. Toward its open side, the bearing seat 42 is widened radially in a stepped manner via radial shoulders 60, 62 and 64. Here, the shoulder represents an axial support for an anti-friction bearing (cf. 88, FIG. 7) of the drive shaft 82, and an inner circumferential face of the bearing seat 42, which cylindrical inner circumferential face extends between the shoulders 62 and 64, represents a radial support for the anti-friction bearing of the drive shaft 82 of the hydraulic machine 4.

In the section A-A, the leakage ducts 44, 46 and the circumferential leakage duct 50 which opens laterally into them can be seen clearly. In accordance with the right-hand side of FIG. 5, the leakage through recess 48 can be seen, which penetrates the connector plate 6, starting from the bottom of the leakage duct 46 as far as a leakage orifice L on the side 68. Approximately halfway up in relation to the vertical axis 58, the secondary leakage connector L' branches off from the leakage through recess 48 radially to the outside, towards the longitudinal side 52 of the connector plate 6 (cf. FIG. 4).

Furthermore, FIG. 5 shows that the leakage duct 46 extends radially to the inside to the shoulder 64 and drops downward in a base-shaped manner (that is to say in the direction of the bearing seat 42) on the other side of the leakage through bore 48. In this way, the bearing seat 42 is also connected fluidically to the leakage connectors L, L'.

The secondary leakage connector L' is connected to the leakage through bore 48 via a throttle point 66 of tapered cross section. One side 68 of the connector plate 6, which side is directed toward the attachment part 8, is of planar configuration.

Figure 6:
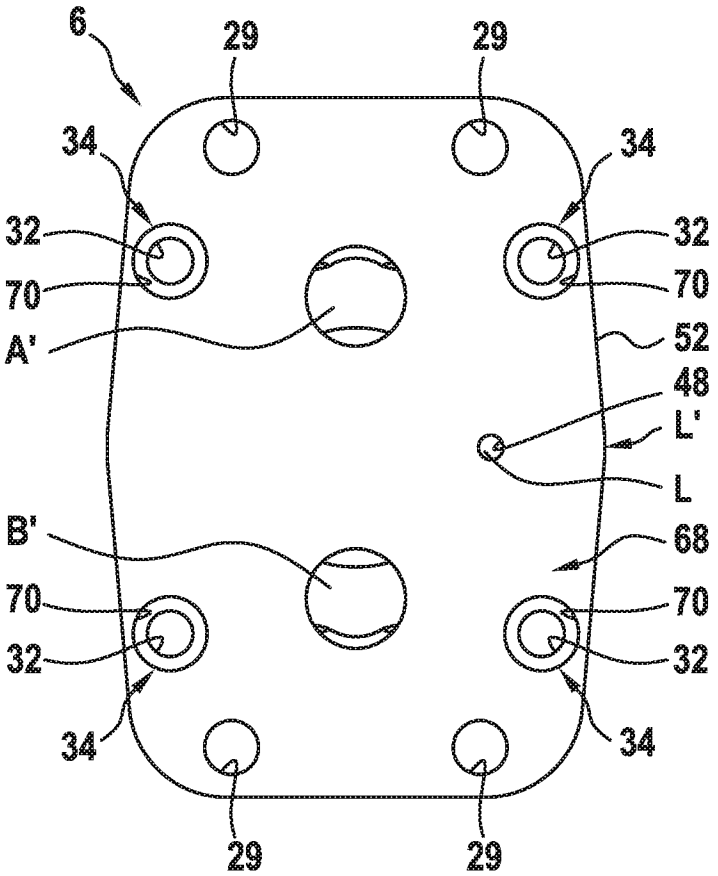
FIG. 6 shows the connector plate of the preceding figures in a plan view, approximately from the direction of the attachment part.

FIG. 6 shows the connector plate 6 in accordance with the preceding figures in a view as afforded from the attachment part 8 (control valve block). The through bores 29, 32 of the first and second fastening means can be seen again, as can the connector recesses A', B' and the leakage through recess 48 or the leakage connector L. The secondary leakage connector L' is indicated on the right-hand side in FIG. 6.

It can be seen as additional information in FIG. 6 that the second through bores 32 are configured in each case as a stepped bore and in each case have a step 70 which is recessed in comparison with the side 68.

In the mounted state of the connector plate 6, a screw head of the second fastening screws 30 (cf. FIG. 3) dips into said step 70.

The screw head (not shown here) terminates flush with the side 68 of the connector plate 6, or the step 70 is configured so as to be so deep that the screw head is even recessed below the side 68, that is to say does not protrude beyond said side 68.

As a result, the connector plate 6 can be mounted or is mounted with its side 68 in a planar manner on the connector face 14 in accordance with FIG. 3 of the attachment part 8.

Therefore, both the second fastening screws 30, the second through bores 32 and the steps 70 belong to the second fastening means 34.

Figure 7:
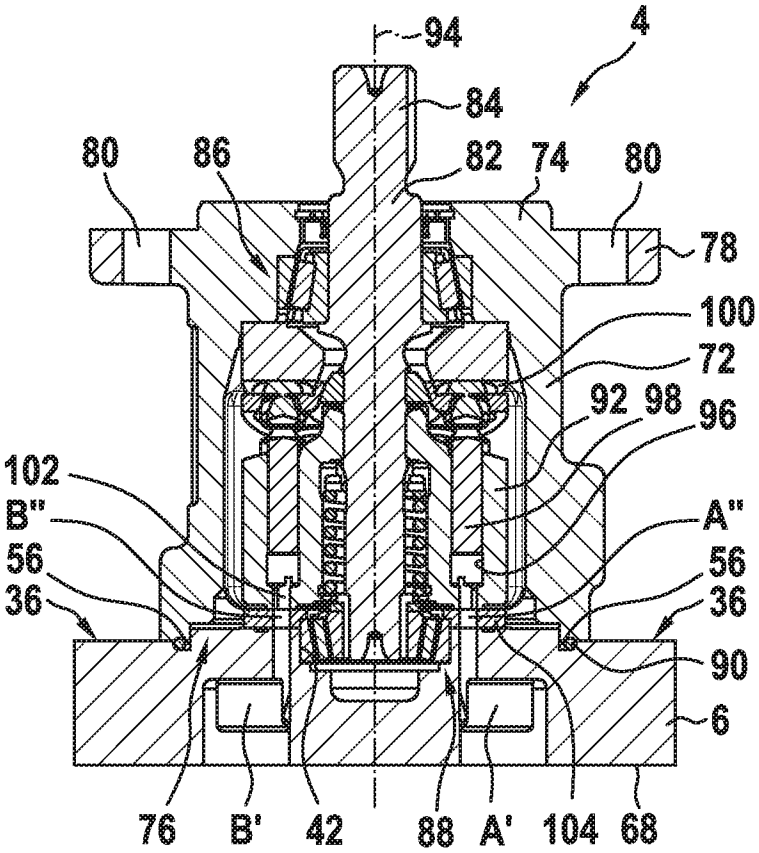
FIG. 7 shows the axial piston machine according to the preceding figures with a mounted connector plate.

FIG. 7 shows the hydraulic machine 4 including the connector plate 6. The hydraulic machine 4 is configured as an axial piston machine of swash plate design. It has a substantially pot-shaped housing 72 with a housing bottom 74 and a housing opening 76. The housing opening 76 is closed by the connector plate 6. A housing flange 78 is configured on the housing bottom 74 radially on the outside, which housing flange 78 has a plurality of through bores 80, via which the hydraulic machine 4 can be connected to the electric drive unit 2 in accordance with FIG. 1. Here, the connection preferably takes place via anti-fatigue screws.

The hydraulic machine 4 has a drive shaft 82 with a splined shaft stub 84 which can be coupled to the electric drive unit 2. The drive shaft 82 is mounted rotatably via anti-friction bearings 86, 88 firstly on the housing bottom 74 and secondly on the bearing seat 42 of the connector plate 6. Here, the connector plate 6 is connected in a block-like manner to the housing 72. Here, the connection takes place via the second fastening means 34 of the connector plate 6, that is to say via the second through bores 32 in accordance with FIG. 6, into which, in accordance with FIG. 3, the second fastening screws 30 are inserted and are screwed into threaded bores (not shown) of the housing 72. Said screw connection is not shown in FIG. 7. An O-ring 90 is inserted into the seal groove 56 in order to seal the interior space of the housing 72 on the connector plate 6.

The hydraulic machine 4 has a cylinder barrel 92 which is connected fixedly to the drive shaft 82 so as to rotate with it and in which cylinder bores 96 are made in a circumferentially distributed manner parallel to a longitudinal axis 94 of the drive shaft 82. Working pistons 98 are guided axially displaceably in said cylinder bores 96, feet of the working pistons 98 being supported in a sliding manner on a swash plate 100 via pads. A working stroke of the working pistons 98 is thus produced in a known way upon rotation of the drive shaft 82.

The cylinder bores 96 have end-side orifices 102 toward the connector plate 6. A control plate 104 with kidney-shaped through recesses A", B" is arranged between an end side of the cylinder barrel and the connector plate 6. Here, the orifices of the latter which point toward the connector plate 6 have the same kidney-shaped form as the orifices 38, 40 of the connector plate 6 (cf., for example, FIG. 4). Upon rotation of the drive shaft 82, the orifices 102 of the working spaces therefore sweep over the orifices of the through recesses A", B" of the control plate 104, as a result of which the connector recesses A', B' pass into alternating pressure medium connection with the working spaces 96.

A closure plate is disclosed having two parallel connector sides, in each case for a hydraulic machine and an attachment part. Here, the connector plate has fastening means for the mechanical and fluidic connection to at least the attachment part, which fastening means are configured in such a way that the attachment part can be connected in a block-like manner. Furthermore, a hydraulic machine having the connector plate is disclosed, said connector plate being connected in a block-like manner to a housing of the hydraulic machine. A hydrostatic unit at least comprising a hydraulic machine and an attachment part is also disclosed, the two components being connected in a block-like manner via the connector plate, in line or in alignment with the driveshaft of the hydraulic machine.

LIST OF DESIGNATIONS

1 Hydrostatic unit
2 Drive unit
4 Hydraulic machine
6 Connector plate
8 Control valve block
10 Hydraulic accumulator
12 Hydraulic cylinder
14 Connector face, attachment part
16 Connector hole pattern, attachment part
18 Fastening hole pattern, attachment part
20 Blind bore
22, 24 Axis of symmetry
26 First fastening screw
28 First fastening means
29 First through bore
30 Second fastening screw
32 Second through recess
34 Second fastening means
36 Side
38, 39, 40 Hydraulic machine-side orifice
42 Bearing seat
44, 46 Leakage duct
48 Through bore, leakage duct
50 Leakage duct
52 Longitudinal side
54 Plane of symmetry
56 Seal groove
60, 62, 64 Shoulder
66 Throttle point
68 Side
70 Step
72 Housing
74 Housing bottom
76 Housing opening
78 Flange
80 Through bore
82 Drive shaft
84 Shaft stub
86, 88 Anti-friction bearing
90 O-ring
92 Cylinder barrel
94 Longitudinal axis
96 Cylinder bore
97 Working space
98 Working piston
100 Swash plate
102 Orifice
104 Control plate
A, B Working connector
L, L' Leakage connector
A', B' Hydrostatic connector recess
A", B" Through recess

The invention claimed is:

1. A hydraulic machine, comprising:
a housing;
a drive shaft; and
a connector plate, including:
a plurality of hydrostatic connector recesses that penetrate through the connector plate, and that each include:
a first orifice on an attachment part side of the connector plate; and
a second orifice on a hydraulic machine side of the connector plate;
wherein the first and second orifices of the plurality of hydrostatic connector recesses are arranged so as to open in a substantially axially parallel manner with respect to the drive shaft of the hydraulic machine;

a first plurality of fastening mechanisms configured to connect the connector plate to a hydraulic attachment part in block-like manner; and a second plurality of fastening mechanisms configured to connect the connector plate to the housing of the hydraulic machine in a block-like configuration, wherein each of two of the plurality of hydrostatic connector recesses is assigned to a respective working connector of the hydraulic machine, and a third of the plurality of hydrostatic connector recesses is assigned to a leakage connector of the hydraulic machine.

2. The hydraulic machine of claim 1, wherein the hydraulic machine is a hydrostatic axial piston machine.

3. The hydraulic machine of claim 2, wherein the connector plate is configured to connect the hydraulic attachment part to the hydrostatic axial piston machine with a swash plate configuration.

4. The hydraulic machine of claim 1, wherein the first plurality of fastening mechanisms and the second plurality of fastening mechanisms are spaced away from the first and second orifices of the plurality of hydrostatic connector recesses.

5. The hydraulic machine of claim 1, wherein each of the first plurality of fastening mechanisms and each of the second plurality of fastening mechanisms respectively includes a bore.

6. The hydraulic machine of claim 5, wherein at least a portion of each bore includes an internal thread or is without a thread.

7. The hydraulic machine of claim 1, wherein connections of the block-like configuration are hose-free.

8. The hydraulic machine of claim 1 wherein at least one of:

the first orifices are arranged in a first pattern that is approximately the same as a hole pattern of the hydraulic attachment part; and the second orifices are arranged in a second pattern that approximately the same as a hole pattern of the hydraulic machine.

9. The hydraulic machine of claim 1, further comprising:

a bearing seat for the drive shaft of the hydraulic machine.

10. The hydraulic machine of claim 1, further comprising:

a cylinder barrel fixedly connected to the drive shaft so as to rotate with the drive shaft, the cylinder barrel including:

a plurality of cylinder bores distributed about the drive shaft; and a plurality of working pistons, each working piston displaceably guided in a respective cylinder bore so as to define a respective hydrostatic working space;

wherein rotation of the drive shaft alternatingly causes two of the hydrostatic working spaces to pass into pressure medium connection with a corresponding two of the plurality of hydrostatic connector recesses of the connector plate.

11. The hydraulic machine of claim 10, further comprising:

a control plate positioned between the cylinder barrel and the connector plate, the control plate including a plurality of through recesses arranged in a pattern that is the same as a hole pattern of the second orifices of the connector plate.

* * * * *